US005141048A

United States Patent [19]

Sausner

[11] Patent Number: 5,141,048

[45] Date of Patent: Aug. 25, 1992

[54] CONDENSER FOR VAPOROUS MATERIALS

[75] Inventor: Andreas Sausner, Frankfurt, Fed. Rep. of Germany

[73] Assignee: Firma Carl Freudenberg, Weinheim, Fed. Rep. of Germany

[21] Appl. No.: 748,746

[22] Filed: Aug. 21, 1991

[30] Foreign Application Priority Data

Sep. 3, 1990 [DE] Fed. Rep. of Germany ..... 4027835

[51] Int. Cl.[5] ..... F28B 9/08

[52] U.S. Cl. ..... 165/110; 165/150; 165/174; 165/913

[58] Field of Search ..... 165/110, 150, 174, 913

[56] References Cited

U.S. PATENT DOCUMENTS

| | | | |
|---|---|---|---|
| 431,574 | 7/1890 | Gaunt | 165/174 |
| 677,876 | 7/1901 | Martin | 165/110 X |
| 1,286,523 | 12/1918 | Brown et al. | 165/110 |
| 1,424,254 | 8/1922 | Mellor | 165/110 |
| 1,908,463 | 5/1933 | Torrance | 165/110 X |
| 4,165,783 | 8/1979 | Oplatka | 165/110 |

FOREIGN PATENT DOCUMENTS

| | | | |
|---|---|---|---|
| 63-271099 | 11/1988 | Japan | 165/913 |

*Primary Examiner*—Allen J. Flanigan
*Attorney, Agent, or Firm*—Kenyon & Kenyon

[57] ABSTRACT

A condenser for vaporous materials, in which at least two pipes are assigned to one another in a series arrangement and are circumflowed by a cooling medium. A separation device is provided at the discharge port of every pipe. This separation device causes the residual vapor to separate from the condensation product. The separation devices are connected via collectors to a pair of collecting chambers from which the condensation product is withdrawn.

10 Claims, 3 Drawing Sheets

CONDENSER FOR VAPOROUS MATERIALS

BACKGROUND OF THE INVENTION

The invention relates generally to a condenser for vaporous materials in which at least two pipes are assigned to one another in a series arrangement and are circumflowed by a cooling medium. More particularly, the invention relates to improvements in such condensers.

Vapor condensers of this general type are known. The condensation output that can be attained with such condensers is relatively small relative to their weight.

This invention is directed towards the further development of this type of condenser to provide a device having a reduced weight relative to its output.

SUMMARY OF THE INVENTION

The invention solves this problem by providing a condenser having a series of pipes arrayed so as to be circumflowed by a cooling medium, e.g. air. These pipes each have an inlet port and a discharge port. The pipes accommodate a vaporous fluid which is condensed by the cooling effect of the circumflowing medium. Vapor which has not condensed after traversing a first pipe in the series is guided to an adjacent pipe in the series so that it can make another pass through the cooling medium for further condensation. A separation device is provided at the discharge port of each pipe. The separation device allows any residual vapor present in each pipe to separate from the condensation product. A collector connected to the separation device is provided to gather the liquid condensation product. In this manner, the uncondensed vapor remaining after traversing a given pipe can be directed to the next pipe for further condensation free from liquid condensate. Consequently, the device comes very close to reaching the theoretically maximum attainable condenser output for any given pipe. Hence, for a desired condensation yield, the total weight of the condenser is less than that of condensers built according to previous designs.

The separation devices can include a baffle for directing the flow of vapor and condensate. These baffles are supported at a distance in front of the discharge ports of each pipe at right angles to the discharge direction. By this means, droplets consisting of the condensate are intercepted and fed to the collector in a reliable manner. The baffles can have box-like shapes that embrace the discharge ports of each pipe, in which every such box-like shape is penetrated at its upper region by a vapor discharge port and, in its lower region, by a collector.

The collectors can be configured as a pair of essentially perpendicularly running ducts, which are connected at their lower end by a line. Such a design makes it quite simple to collect and draw off the condensation product. To simplify production and to provide a device that can readily be adapted to the particular requirements of a specific application, it is recommended that the entire condenser be given a modular construction.

According to one embodiment of the condenser design, the pipes are horizontally arrayed to extend at generally right angles to the longitudinal axis and driving direction of a motor vehicle. The collectors at the left hand and right hand ends of the pipes are connected via their bottom sides to a collecting chamber. These two collecting chambers are connected by a line placing the two collecting chambers in hydraulic communication with each other. At the lower ends of both the left hand side and the right hand side of the condenser, a float valve is provided between each of the collecting chambers and its corresponding collector. Under normal operating conditions, the two collecting chambers are filled with condensate to the extent that the float valve is in the open position, and the suction port of a device to be cooled by the condensate is amply supplied with condensate. This assures that the device is cooled and that the collecting chambers are continuously replenished with newly condensed condensation product.

When a motor vehicle travels along a curved route, the condensate contained in the two collecting chambers is subject to centrifugal forces, and can experience a displacement toward the outside of the curve of the automobile's motion. Consequently, the condensation components accumulate in the collecting chamber situated at the outer portion of the curve, which causes the float valve to be shifted into a closed position. This limits the extent to which the condensation components can undergo relative displacement from one side of the condenser to the other so that this flow does not reach a critical level. Therefore, the device to be cooled by the condensate is assured of an ample and reliable supply of condensate, independent of the magnitude of the accelerative forces exerted in the transverse direction. Furthermore, the condensation output as such is not adversely affected to any significant degree in extreme situations. In the worst case, the condensation components can accumulate somewhat in the last of the pipes assigned to one another in series arrangement. Under the more typical operating conditions usually encountered, this is of no further importance.

This device provides for the efficient separation of all condensation products between the successive pipes even where the vapor that is fed to the condenser has a high flow rate, which is reflected in the considerable savings of weight realizable with this design.

DETAILED DESCRIPTION OF THE INVENTION

Figure 1:
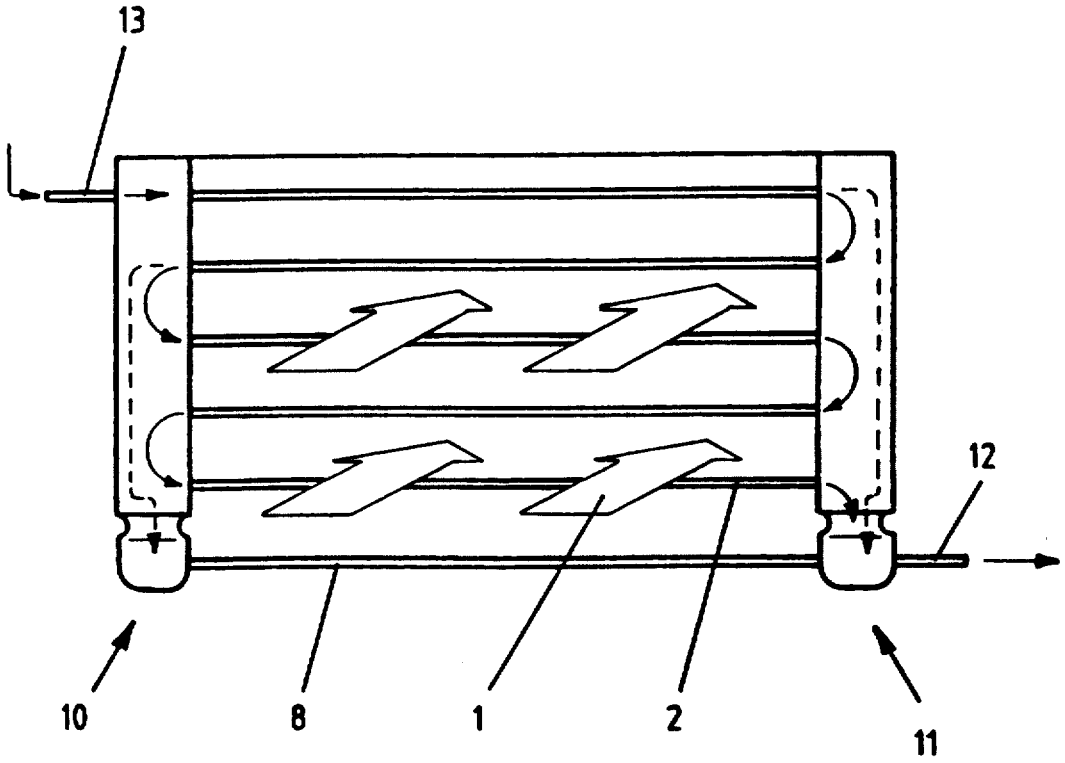
FIG. 1 is a schematic front plan view of the condenser constructed according to the principles of the invention.

A typical application of the condenser depicted in FIG. 1 is the continuous condensation of vapors, such as for providing coolant for an internal combustion engine. The condenser has a left housing part 10 and a right housing part 11, which are interconnected by pipes 2. Where the condenser is to be placed in a motor vehicle, these pipes may be arranged to extend horizontally at right angles to the longitudinal axis and straight-line driving direction of the motor vehicle. The pipes 2 are arranged at a distance from one another so that cooling air 1 can flow freely around them. They can optionally be provided with additional cooling fins or the like to affect further heat transfer from the vapor within the pipes for enhanced condensation.

At its upper end, the left housing part 10 is provided with an intake port 13 for supplying a vaporous material. The right housing part 11 is provided with a bleed port 12, which emerges at the lower end and serves to remove the condensation product. This port may be connected, for example, to the suction port of the coolant pump of an internal combustion engine.

Both housings 10, 11 are provided at their lower ends with collecting chambers 9 having an enlarged cross-section. They are interconnected by a line 8. By this means, the fluid level of the condensate contained in the two collecting chambers may be equalized.

Figure 2:
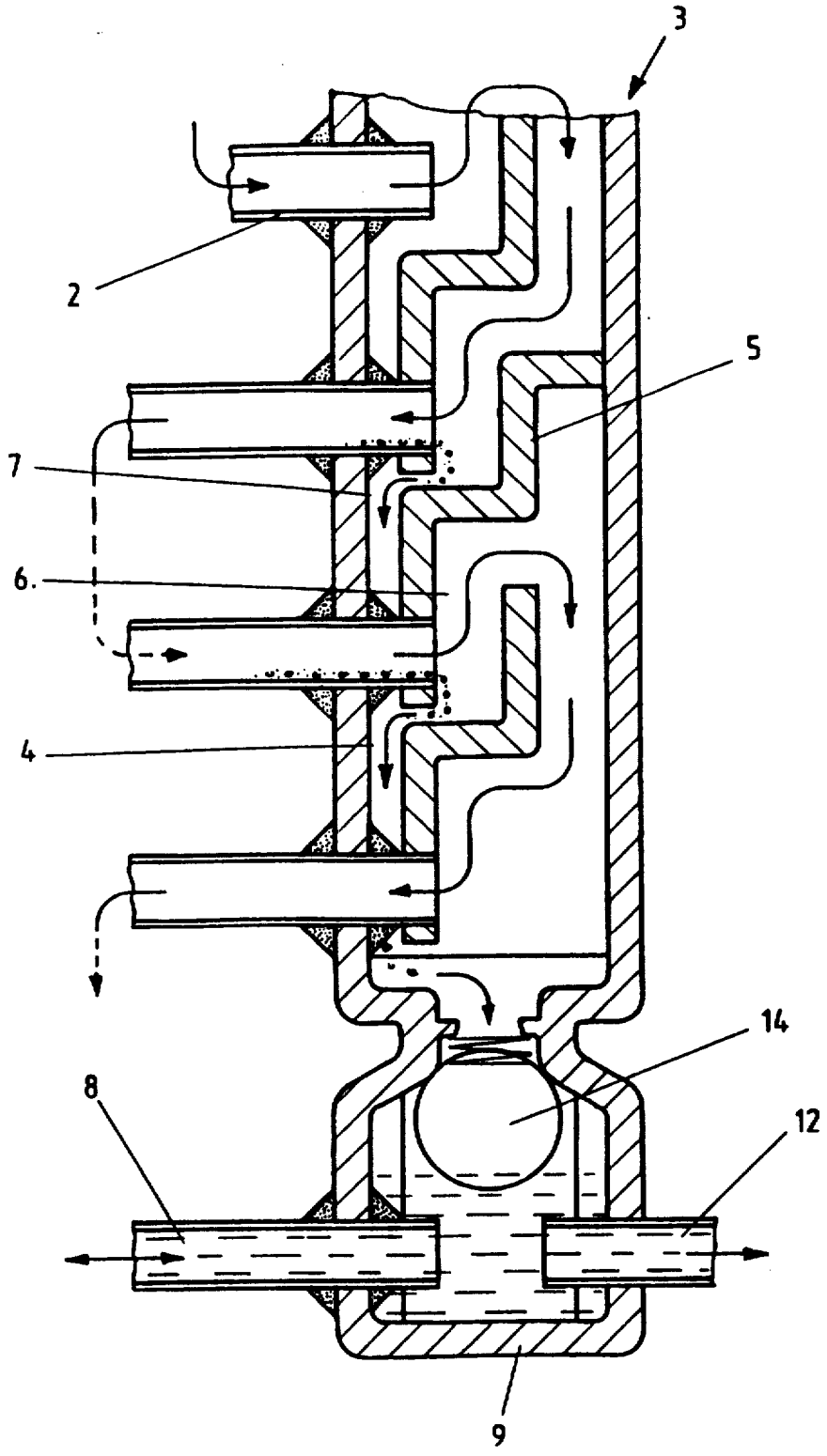
FIG. 2 is a cross-section view of the right part of the condenser shown in FIG. 1.

In FIG. 2, the right housing part is partially reproduced representation in longitudinal section. It is made of a plastic molded part, into which are run the metallic pipes 2 that provide the actual condensation from the vaporous material. A baffle, which extends at right angles to the discharge direction, is arranged at a distance opposite the discharge port of the pipes 2. The baffle 5 is provided with extensions, giving it on the whole a box-like shape, so that it surrounds the discharge ports of the pipes accordingly. The box formed by the baffle is pierced at the upper end by a vapor discharge port 6, and at the lower end by the condensation collector 7.

The vapor discharge ports are designed so that any uncondensed vapor emerging from one pipe is deflected to the next pipe with which it is in series. The condensation collectors 4 are made of perpendicularly running ducts, which lead at the lower end into collecting chambers 9, which are interconnected by a line 8. A float valve 14 is arranged between the collecting chambers 9 and the collectors 4. This float valve is designed to allow the connection between the collecting chamber 9 and the collector 4 to be interrupted when the fluid build-up in the corresponding collecting chamber 9 reaches an unacceptable level. This may be the case, for example, when large accelerative forces are introduced parallel to the direction of the line 8. Thus, in a condenser built according to this invention, these forces no longer cause the fluid level in the opposite collecting chamber 9 to drop to an unacceptable level. This guarantees that the suction port 12 overflows completely under all operating conditions, and concomitantly that the device connected to the suction port 12 is adequately supplied with condensate.

Figure 3:
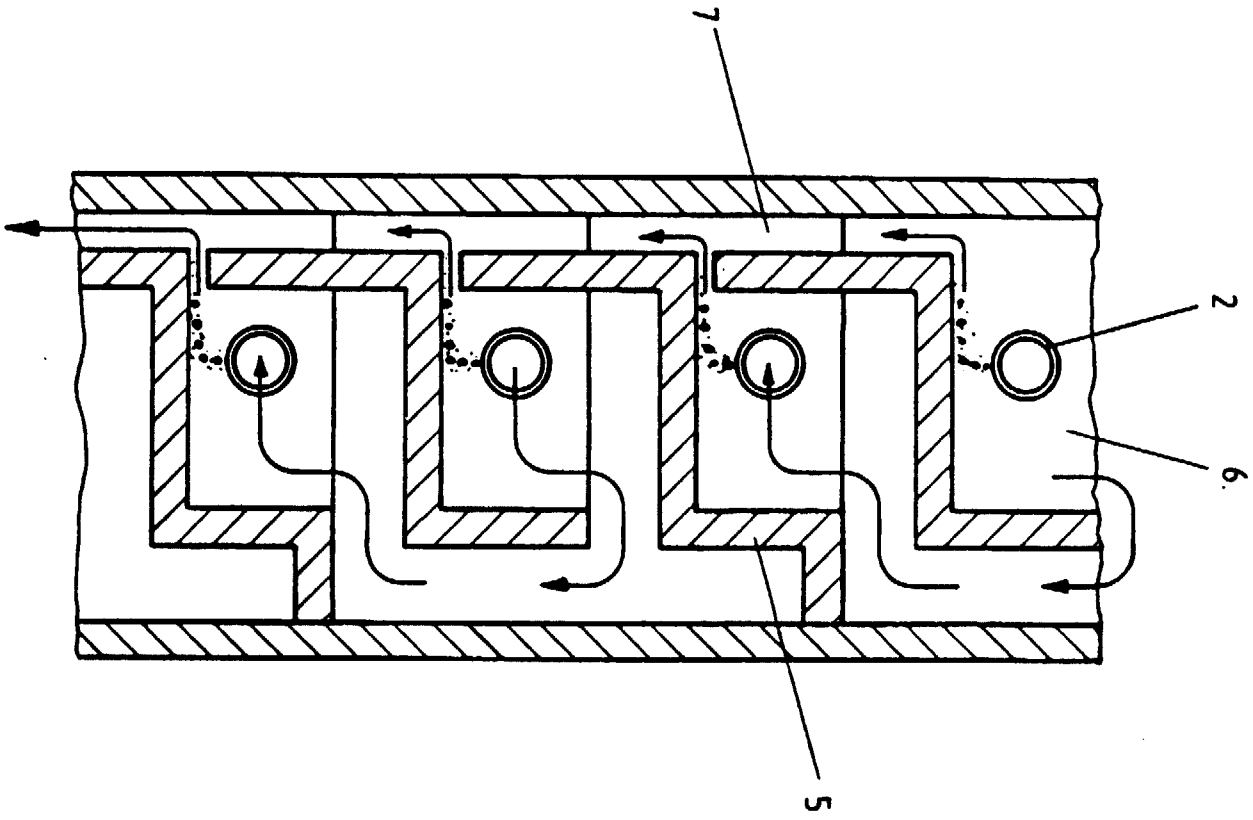
FIG. 3 is a cross-sectional representation of that part of the condenser illustrated in FIG. 2.

FIG. 3 depicts the cut-away portion of FIG. 2 in a cross-sectional representation. One can see that the baffles have a box shape and that the collectors 7 are staggered laterally relative to the pipes 2.

What is claimed is:

1. A condenser for vaporous materials, comprising:

a plurality of pipes for carrying vapor, each of said pipes having a first end and a second end, one of said ends of each pipe serving as an inlet port and one of said ends serving as a discharge port, said pipes being in series arrangement with one another so that the contents of a first pipe can flow into an adjacent pipe, said pipes further being arrayed so that they can be circumflowed by a cooling medium which assists in the transformation of vapor into liquid condensate as the vapor flows through the pipes;

a plurality of separation devices located at the discharge port of each pipe, said separation devices comprising baffles and acting to separate residual vapor from the condensate that discharges from the pipe; and a collector connected to each of said separation devices for collecting the condensate.

2. A condenser for vaporous materials, comprising:

a plurality of pipes for carrying vapor, each of said pipes having a first end and a second end, one of said ends of each pipe serving as an inlet port and one of said ends serving as a discharge port, said pipes being in series arrangement with one another so that the contents of a first pipe can flow into an adjacent pipe, said pipes further being arrayed so that they can be circumflowed by a cooling medium which assists in the transformation of vapor into liquid condensate as the vapor flows through the pipes;

a plurality of separation devices located at the discharge port of each pipe, said separation devices acting to separate residual vapor from the condensate that discharges from the pipe, wherein the separation devices comprise a baffle and said baffles are supported at a distance in front of the discharge ports at right angles with respect to the discharge direction; and a collector connected to each of said separation devices for collecting the condensate.

3. The condenser according to claim 2, wherein the baffles have a box-like shape which embraces the discharge ports of each pipe, and every box-like shape is penetrated in its upper region by a vapor discharge port and in its lower region by the collector.

4. A condenser for vaporous materials, comprising:

a plurality of pipes for carrying vapor, each of said pipes having a first end and a second end, one of said ends of each pipe serving as an inlet port and one of said ends serving as a discharge port, said pipes being in series arrangement with one another so that the contents of a first pipe can flow into an adjacent pipe, said pipes further being arrayed so that they can be circumflowed by a cooling medium which assists in the transformation of vapor into liquid condensate as the vapor flows through the pipes;

a plurality of separation devices located at the discharge port of each pipe, said separation devices acting to separate residual vapor from the condensate that discharges from the pipe; and a plurality of collectors connected to said separation devices for collecting the condensate, wherein the collectors are arrayed as generally perpendicularly running ducts, and the ducts are connected at their lower ends by a line.

5. The condenser according to claim 2, wherein the collectors are arrayed as generally perpendicularly running ducts, and the ducts are connected at their lower ends by a line.

6. The condenser according to claim 3, wherein the collectors are arrayed as generally perpendicularly running ducts, and the ducts are connected at their lower ends by a line.

7. A condenser for vaporous materials, comprising:

a plurality of pipes for carrying vapor, each of said pipes having a first end and a second end, one of said ends of each pipe serving as an inlet port and one of said ends serving as a discharge port, said pipes being in series arrangement with one another so that the contents of a first pipe can flow into an adjacent pipe, said pipes further being arrayed so that they can be circumflowed by a cooling medium which assists in the transformation of vapor into liquid condensate as the vapor flows through the pipes;

a plurality of separation devices located at the discharge port of each pipe, said separation devices acting to separate residual vapor from the condensate that discharges from the pipe, and a plurality of collectors connected to said separation devices for collecting the condensate, wherein the collectors are arrayed as generally perpendicularly running ducts, and the ducts are connected at their lower ends by a line and wherein the collectors are provided at the outlet ends of the pipes so that they empty on the bottom side into a collecting chamber on each side of the condenser, said collecting chambers being connected by a line, and further comprising a float valve between each collecting chamber and its corresponding collector.

8. The condenser according to claim 5, wherein the collectors are provided at the outlet ends of the pipes so that they empty on the bottom side into a collecting chamber on each side of the condenser, said collecting chambers being connected by a line, and further comprising a float valve between each collecting chamber and its corresponding collector.

9. The condenser according to claim 6, wherein the collectors are provided at the outlet ends of the pipes so that they empty on the bottom side into a collecting chamber on each side of the condenser, said collecting chambers being connected by a line, and further comprising a float valve between each collecting chamber and its corresponding collector.

10. A condenser for use in an automobile having a longitudinal axis corresponding to the direction in which the automobile moves when it undergoes straight line motion, comprising:

a plurality of pipes for carrying vapor, in which the pipes are horizontally arranged at generally right angles with respect to the longitudinal axis of a motor vehicle, each of said pipes having a first end and a second end, one of said ends of each pipe serving as an inlet port and one of said ends serving as a discharge port, said pipes being in series arrangement with one another so that the contents of a first pipe can flow into an adjacent pipe, said pipes further being arrayed so that they can be circumflowed by a cooling medium which assists in the transformation of vapor into liquid condensate as the vapor flows through the pipes;

a plurality of separation devices located at the discharge port of each pipe, said separation devices acting to separate residual vapor from the condensate that discharges from the pipe;

a left hand and a right hand collecting chamber for collecting condensate;

a collector associated with each of said separation devices for collecting the condensate from its corresponding pipe, wherein the collectors are provided at the ends of the pipes so that they empty on the bottom side into the collecting chamber;

a line connecting said collecting chambers; and a float valve between every collecting chamber and the corresponding collector that empties into the collecting chamber

* * * * *